US007266984B2

(12) United States Patent
Cerv et al.

(10) Patent No.: US 7,266,984 B2
(45) Date of Patent: Sep. 11, 2007

(54) METHOD AND NOZZLE ARRANGEMENT FOR A VARIABLE-WIDTH LUBRICATION OF THE ROLLING-NIP OF A ROLLING STAND

(75) Inventors: Horst Cerv, Freudenberg (DE); Heinz Hopfenziz, Freudenberg (DE); Jürgen Armenat, Kreuztal (DE); Rudolf-Franz Jäger, Hilchenbach (DE); Jürgen Seidel, Kreuztal (DE)

(73) Assignee: SMS Demag AG, Düsseldorf (DE)

( * ) Notice: Subject to any disclaimer, the term of this patent is extended or adjusted under 35 U.S.C. 154(b) by 379 days.

(21) Appl. No.: 10/481,929

(22) PCT Filed: Jun. 11, 2002

(86) PCT No.: PCT/EP02/06353

§ 371 (c)(1),
(2), (4) Date: Jun. 3, 2004

(87) PCT Pub. No.: WO03/000437

PCT Pub. Date: Jan. 3, 2003

(65) Prior Publication Data

US 2004/0232258 A1 Nov. 25, 2004

(30) Foreign Application Priority Data

Jun. 23, 2001 (DE) ..... 101 30 445

(51) Int. Cl.
*B21B 27/10* (2006.01)
*B21B 45/02* (2006.01)

(52) U.S. Cl. ..... 72/236; 72/41; 72/43

(58) Field of Classification Search ..... 72/236, 72/241.2, 41, 42, 43, 44, 201
See application file for complete search history.

(56) References Cited

U.S. PATENT DOCUMENTS 3,803,888 A * 4/1974 Hostetter et al. ..... 72/45

(Continued)

FOREIGN PATENT DOCUMENTS

EP 776710 A1 * 6/1997
EP 1040877 10/2000

OTHER PUBLICATIONS

Patent Abstracts of Japan, vol. 015, No. 333 (M-1150), Aug. 23, 1991 & JP 03 128113 A (Kawasaki Steel Corp) May 31, 1991.

(Continued)

*Primary Examiner*—Dmitry Suhol
(74) *Attorney, Agent, or Firm*—Friedrich Kueffner

(57) ABSTRACT

The invention relates to a method for lubricating rolls, in particular for lubricating a rolling nip in rolling stands for rolled strips. According to the invention, said lubrication takes place using an oil-in-water dispersion whilst maintaining both a predetermined blend characteristic and a volumetric flow of the dispersion. The dispersion is prepared in the form of a homogeneous blend in a mixer (1) using adjustable quantities of water and oil. The dispersion is supplied to various spray zones (Zi) for a distribution (Bi) that is variable in width. Said method for roll lubrication can be improved by the allocation of at least one row of nozzles (Di) to each spray zone (Zi), which has a corresponding spray range width (Bi), each nozzle being controlled by at least one relay valve (Si).

6 Claims, 2 Drawing Sheets

U.S. PATENT DOCUMENTS

| | | | | | |
|---|---|---|---|---|---|
| 5,090,225 | A | * | 2/1992 | Schimion | 72/45 |
| 5,524,465 | A | * | 6/1996 | Kajiwara et al. | 72/42 |
| 5,799,529 | A | * | 9/1998 | Kivisto et al. | 72/340 |
| 6,089,069 | A | * | 7/2000 | Seidel et al. | 72/236 |

OTHER PUBLICATIONS

Patent Abstracts of Japan, vol. 1997, No. 05, May 30, 1997 & JP 09 101817 A (Kawasaki Steel Corp), Jan. 14, 1997.

* cited by examiner

METHOD AND NOZZLE ARRANGEMENT FOR A VARIABLE-WIDTH LUBRICATION OF THE ROLLING-NIP OF A ROLLING STAND

The invention pertains to a process for roll lubrication, especially for the lubrication of the roll nip, in rolling stands for rolled strip with an oil-in-water dispersion under maintenance of both a predetermined mixture characteristic and a volume flow rate of the dispersion, where this dispersion is prepared in a mixer with adjustable quantitative ratios of water and oil to form a homogeneous dispersion, and where at least one row of nozzles, each of which is controlled by at least one on-off valve, is assigned to each spray zone with an assignable strip spray width. The invention also pertains to a nozzle arrangement for implementing the process according to the invention.

The effectiveness of roll lubrication, especially the lubrication of the nip, in the rolling stands used for the production of hot-rolled strip is crucially dependent on the production of a dispersion in the form of a water-in-oil mixture consisting of droplets of oil in water, which are not dissolved in each other and whose composition is constant. Because the strips can be of different widths, however, this dispersion must also be made compatible with the requirements of lubricating different widths of the rolls or roll nips.

In known nip lubricating systems comprising only one mixer, the mixing conditions cannot be kept-uniform when additional nozzles are turned on to expand the width of the spray zones. The dispersion is produced in the mixer. In it, a predetermined amount of water flows through the mixing system at a given pressure and thus at the corresponding flow velocity. The flow velocity can be considered an essential factor of the mixing process.

Figure 1:
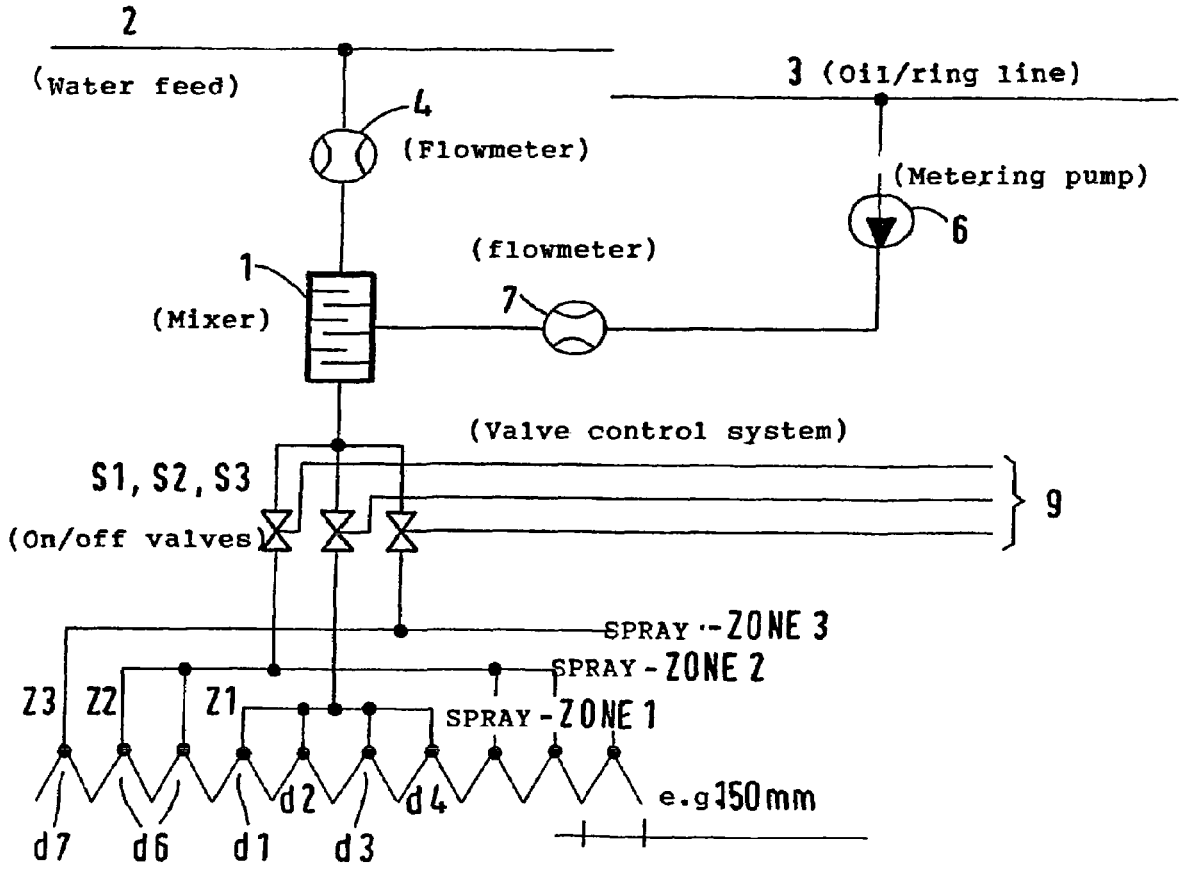
FIG. 1 Prior Art

If now, as illustrated by way of example in FIG. 1, which shows a diagram of a roll nip lubricating system according to the state of the art, additional nozzles are turned on to deal with an increase in the width of the strip, the amount of water also increases. Because this larger amount of water must still flow through the same cross section in the mixer and through the downstream pipeline system, the flow velocity increases in accordance with the continuity equation. If the oil-and-water mixing process is designed for the maximum volume flow rate, the effectiveness at minimum strip width and thus at minimum volume flow rate will diminish significantly as a result of the decrease in flow velocity. The stability of the dispersion as it flows through the feed line to the piping system also decreases.

As shown in the example according to FIG. 1, ten nozzles, for example, are connected together to form three groups, which are installed in an elevated structure forming part of a width-dependent roll nip lubricating system. A strip of minimum width requires four nozzles. Depending on the width of the strip, the number of nozzles can be increased in sequence in increments of two. On a purely mathematical basis, therefore, a nonuniformity of 4/10 or 1/2.5 arises with respect to the amount of water.

If this disadvantage is to be eliminated, it would be necessary to use several mixers and thus also more pumps and their pipelines, the exact number depending on the width of the strip, in order to achieve ideal flow and mixing conditions at all times.

The document EP 1 040 877 A1 describes a device for lubricating the rolls or the roll nip of a rolling stand. The spray device, which corresponds to the previously mentioned state of the art, has three on-off valves. The spent dispersion is also collected, separated into its two phases, i.e., water and oil, reprocessed, and returned to the device.

Here an emulsion with 2% oil in water is prepared in a mixer tank and mixed by an agitator. The device is designed with triple dovetail nozzles to produce a flat spray jet, extending across the width of the strip.

The document EP 0 367 967 B1 describes a process for cooling and lubricating the rolls of a rolling stand during the cold-rolling of metal strip, in which emulsifiers and an oil/water emulsion containing at least one oil phase are supplied through nip emulsion nozzles. The emulsion is produced in a dispersing unit by the separate infeed of the media forming the emulsion, this being done upstream of the rolls of the rolling stand or upstream of the entrance of the strip into the nip formed by the working rolls. After the emulsion has performed its cooling and lubricating function, it is collected downstream of the rolling stand and separated; the separate liquid phases are used separately to produce the starting emulsion again.

With this circulating emulsion system, any desired oil concentration can be obtained in the emulsion to meet the specifications of the rolling process whenever desired and with an extremely short lag time. As a result of the lag-free flexibility of this cooling and lubricating system for cold-rolling mills, it is possible to achieve better product quality with respect to surface finish and the flatness of the rolled strip. In addition, the process of preparing the emulsion is simplified, and it is also done with less burden to the environment. At the same time, the system costs are lower than those of the known circulating emulsion systems.

The document EP 0 776 710 A1 discloses a device for influencing the profile of rolled strip. To prevent the "edge drops" which can form during the cold-rolling of a strip, it is proposed that the areas of the working rolls which come in contact with the edges of the strip be cooled in an automatically controlled manner in such a way that, as a result of the change in the crowning caused by the cooling effect, the edge drops, which are caused essentially by the transverse flow behavior of the material, are automatically counteracted. For this purpose, an additional spray beam is assigned to each end of the barrel of each roll, the range over which these beams act extending from the end of the barrel to the edge of the strip facing the end of the barrel.

According to the document JP 03[1991]-128,113, for the purpose of achieving a significant decrease in the time lag associated with stopping the injection of rolling oil, a stop valve on the outlet side of a mixer is equipped with a connecting line for hot water so that the mixer and the closing valve can be bypassed.

Proceeding from the state of the art indicated above, the invention is based on the task of providing a process and a nozzle arrangement by means of which strips of different widths can be sprayed, where it can always be assumed that the adjustable volume flow rate of the water will remain constant, and where the mixture of the water/oil phases will always remain constant (ideal) as well.

To accomplish this task, the inventive process for roll lubrication, especially for nip lubrication, in rolling stands for rolled strip in accordance with the introductory clause of claim 1 provides that the total amount of dispersion for one spray zone is discharged through only one on-off valve and that the various rows of nozzles are designed so that, after the on-off valve in question has been actuated and under the assumption that the complete set of nozzle bores of an individual row is being used, each row will have the same volume flow rate as each of the others, with the result that the flow conditions in the mixer are the same for each spray zone.

Additional embodiments of the process are provided as indicated in the associated subclaims.

A nozzle arrangement according to the invention for roll lubrication, especially for roll nip lubrication in rolling stands for rolled strip for implementing the process, is characterized in that all of the spray nozzles of a spray zone required for the preset volume flow rate of the spray medium are arranged in a separate row of nozzles, each row being connected to at least one controllable on-off valve, and in that the various rows of nozzles are designed so that, when all of the nozzles bores of an individual row are being used, each row of nozzles has the same volume flow rate as each of the others. As a result of this measure, the flow conditions in the dispersion mixer are always the same, and thus the water and oil components are always mixed together in the same way. The most important factor for the mixing process is therefore the flow velocity of the water and not the quantity of oil.

Additional embodiments of the nozzle arrangement are provided in correspondence with the subclaims.

With these measures, it is possible advantageously to spray strips of the following widths, for example:

1. Strips up to 900 mm wide: water, about 20 L/min+0.25 L/min oil=20.25 L/min

2. Strips up to 1,350 mm wide: water, about 20 L/min+0.3 L/min oil=20.30 L/min

3. Strips up to 1,800 mm wide: water, about 20 L/min+0.40 L/min oil=20.40 L/min

By means of the claimed process, ideal mixtures are produced regardless of the width of the strip, where only a single mixer with pump, piping, and return line is required for strip of any width, and where only three on-off valves of the same model series are required to control the quantity of dispersion for all the spray zones.

As a result of the inventive measures, according to which the various rows of nozzles are designed in such a way that, after the on-off valve has been actuated, the complete set of nozzle bores of an individual row will always discharge the same amount as every other row, the advantageous goal is achieved that the flow conditions in the mixer will remain the same for each spray zone. As a result, ideal, comparable conditions are always maintained.

The process according to the invention also provides that the proportion of oil in the dispersion is increased from, for example, 0.25% to 0.40% to accommodate the selection of a spray zone of increased width.

Finally, another embodiment of the process according to the invention provides that the cone angle $\alpha$ of the nozzle bores and/or their number is designed to suit the spray width of each row of nozzles.

In another advantageous embodiment of the invention, it is provided that the rows of nozzles are spaced more-or-less uniformly along a nozzle beam, parallel to the rolls or to the nip between the rolls. The width can thus be adjusted precisely by adjusting either the spacing of the nozzles in each row, the cone angle of the nozzles, or the number of nozzles or by adjusting a combination of cone angle, number, and spacing in each row.

Additional advantageous embodiments of the nozzle arrangement are described in the other subclaims.

Figure 2:
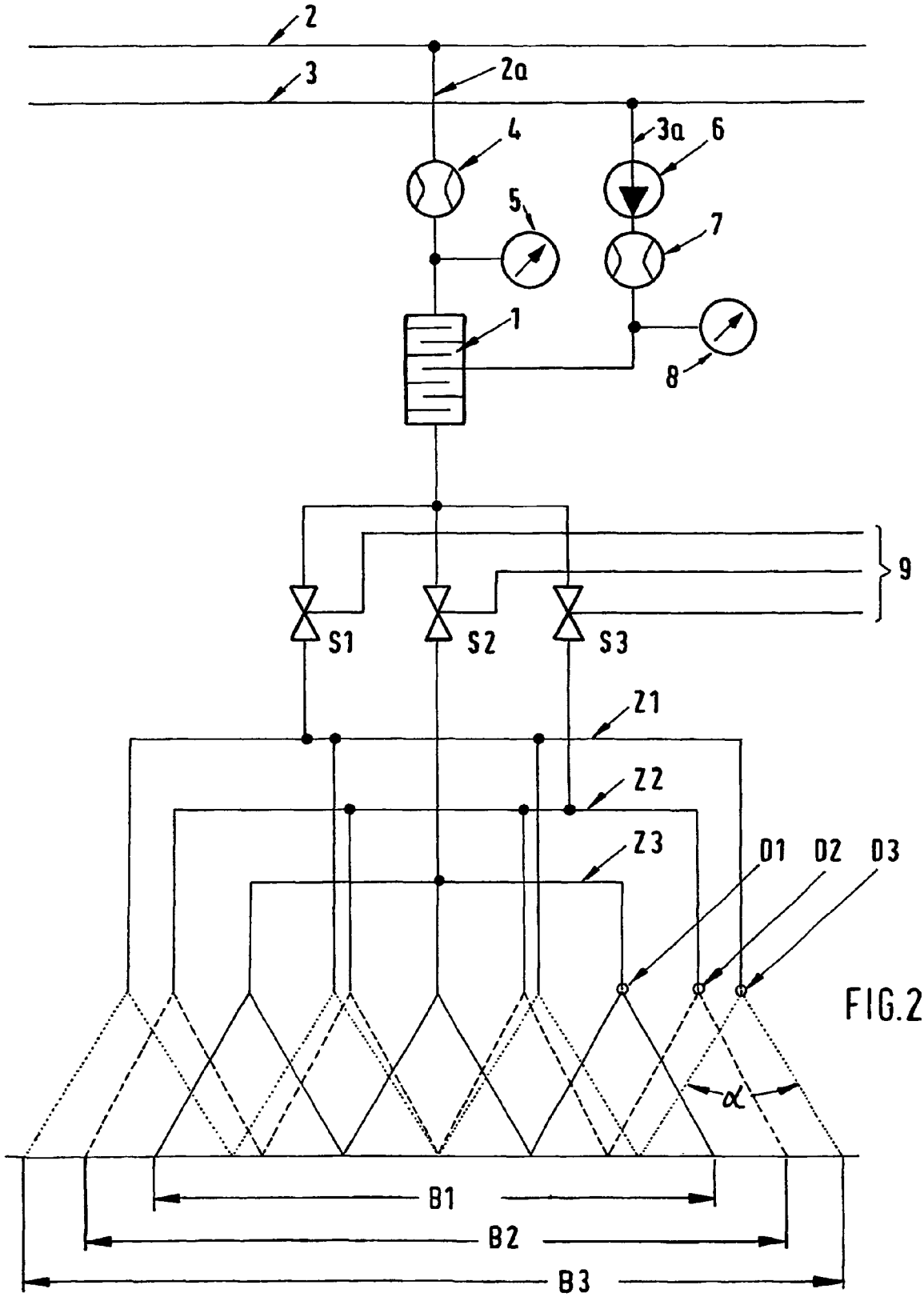

Details, features, and advantages of the invention can be derived from the following explanation of an exemplary embodiment, illustrated schematically in the drawing:

FIG. 1 shows an operating schematic and circuit diagram of a device for roll lubrication according to the state of the art; and FIG. 2 shows a device for roll lubrication according to the invention.

The device shown in FIG. 1 for lubricating the roll nip or the rolls of a rolling stand (not shown) with width adjustment according to the state of the art has a water feed 2 line and an oil feed line 3. The two media are supplied to the device under pressure. The reference numbers 4 and 7 designate flowmeters for the two media, water and oil. The number 6 designates a metering pump for the proportional feed of small amounts of dispersion oil. The number 1 designates a mixer, known in and of itself, in which the two media, water and oil, are mixed intimately together. S1-S3 designate three on-off valves, which can be actuated individually by means of, for example, compressed air 9. Each of these on-off valves S1-S3 is connected to a spray zone Z1-Z3.

In the example shown, four spray nozzles d1-d4 are assigned to spray zone Z1. Four actuatable nozzles d6 are assigned to spray zone Z2, and two additional spray nozzles d7 are assigned to spray zone Z3.

When now, as illustrated in FIG. 1, the width-dependent nozzles d6 and d7 of zones Z2 and Z3 are added to Zone 1, the amount of water that is required increases. Because the amount of water must always flow through the same cross section in the mixer 1, the flow velocity increases again each time an on-off valve S2, S3 is turned on. If the mixture of oil and water is designed for the maximum flow rate, the effectiveness in the case of a strip of minimum width and thus the minimum amount of water will decrease sharply. The stability of the dispersion as it flows through the feed line to the pipes also decreases.

As illustrated in FIG. 1, ten nozzles in all are connected in such a way that three spray zones Z1-Z3 are created in the example shown. The minimum strip width requires the four nozzles d1-d4. Depending on the width of the strip, up to six nozzles, i.e., three nozzles d5, d6, d7 on the right and three nozzles d5, d6, d7 on the left, can also be connected. On a purely mathematical basis, therefore, a nonuniformity of 4/10 or 1/2.5 thus arises with respect to the amount of water.

The disadvantage of the device according to FIG. 1 is avoided by the design of a device for roll lubrication with an oil-in-water dispersion as shown in FIG. 2.

The circuit diagram of the device according to the invention according to FIG. 2 also shows a feed line 2 for water, a feed line 3 for oil, a flowmeter 4 for water, and a flowmeter 7 for oil. Reference numbers 5 and 8 designate pressure meters for water and oil, and reference number 6 designates a metering pump for supplying the appropriate amounts of oil.

The media water and oil are processed intimately in the mixer 1 to form a homogeneous dispersion. This dispersion is a water-in-oil mixture consisting of extremely fine droplets of oil in the water. The dispersion is sent first to three on-off valves S1-S3 for the variable-width distribution of the dispersion across the rolls of a rolling stand (not shown). From there, the path leads to the various spray zones Z1-Z3. Each of the on-off valves S1, S3, S2 supplies its own separate spray zone Z1-Z3. Each spray zone Z1, Z2, Z3 has an assigned strip spray width B3-B1 with an assigned row of nozzles D3-D1.

With this nozzle arrangement according to the invention, the goal is achieved that the total amount of dispersion for a connectable spray zone Z1-Z3 with an assigned nozzle row D3-D1 for a spray width B3-B1 is discharged through only a single on-off valve S1-S3 in each case. The various nozzle rows D3-D1 are designed in such a way that, after the on-off valve S1-S3 has been actuated and under the assumption that all of the nozzle bores are being used, the volume flow rates of the dispersion will be the same in each row, and thus the flow conditions in the mixer 1 will always be the same for each of the spray zones Z1-Z3. When a spray zone of greater width is selected, the proportion of oil in the dispersion is also increased from, for example, 0.25% to 0.40%. When a spray zone of lesser width is selected, the proportion of oil in the dispersion will be reduced correspondingly.

The cone angle α of the nozzle bores shown in FIG. 2 and/or their number is designed to suit the strip spray width B3-B1 of the individual nozzle row. The various nozzle rows D3-D1 are designed so that the nozzle bores of each row produce the same volume flow rate as that of each of the other rows, which means that the flow conditions in the mixer 1 and thus the mixture of the water and oil components remain constant at all times.

It is especially clear from the diagram of the inventive arrangement in FIG. 2 that only a single mixer is assigned to the nozzle rows D1-D3, i.e., to the assignable on-off valves S2, S3, S1, with the appropriate connections for water and oil. This compensates for the slightly larger number of nozzles in comparison with the state of the art. The advantages of the nozzle arrangement according to the invention are:

ideal mixing, regardless of width;

only one mixer required for all strip widths; and e.g., only three on-off valves of one model series required for the entire amount of dispersion supplied to, for example, three different spray widths.

The invention claimed is:

1. Process for roll lubrication, especially for roll nip lubrication, in rolling stands for rolled strip with an oil-in-water dispersion under maintenance of both a predetermined mixture characteristic and a volume flow rate of the dispersion, where this dispersion is prepared in a mixer (1) with adjustable quantitative ratios of water and oil to obtain a homogeneous dispersion, the dispersion then being discharged to various spray zones (Zi) for distribution over variable widths (Bi), and where at least one row of nozzles (Di), each of which is controlled by at least one on-off valve (Si), is assigned to each spray zone (Zi) with an assignable strip spray width (Bi), wherein the total amount of dispersion for one spray zone (Zi) is discharged through only one on-off valve (Si), each row of nozzles (Di) is designed so that, after the one on-off valve (Si) has been actuated and under the assumption that the complete set of nozzle bores of an individual row is being used, each row will have the same volume flow rate as each other row of nozzles, with the result that the flow conditions in the mixer (1) are the same for each spray zone (Zi).

2. Process according to claim 1, wherein, when a spray zone (Zi) of greater width is selected, the proportion of oil in the dispersion is increased from 0.25% to 0.40%.

3. Process according to claim 1, wherein a cone angle (a) of the nozzles and/or their number and/or their spacing in each nozzle row (Di) is designed to suit the strip spray width (Bi).

4. Nozzle arrangement for roll lubrication, especially roll nip lubrication, in the rolling stands for rolled strip for implementing the process according to claim 1, wherein all of the spray nozzles of a spray zone (Zi) required for each presettable volume flow rate of the spray medium are arranged in a separate nozzle row (Di), each row being connected to at least one controllable on-off valve (Si), each row of nozzles (Di) is designed so that, when all of the nozzle bores are being used, each row produces the same volume flow rate as each other row of nozzles.

5. Nozzle arrangement according to claim 4, wherein the rows of nozzles (Di) are spaced substantially uniformly in a nozzle beam, parallel to the rolls or to the roll nip of the rolling stand.

6. Nozzle arrangement according to claim 4, wherein only a single mixer (1), equipped with the appropriate connections for water and oil and with metering pumps (6) and flowmeters (4, 7) installed in the connecting lines, is assigned to the rows of nozzles (Di) or to the on-off valves (Si).

* * * * *